US006328611B1

(12) United States Patent
Kobayashi

(10) Patent No.: US 6,328,611 B1
(45) Date of Patent: Dec. 11, 2001

(54) CONNECTOR FOR A SOCKET

(75) Inventor: Haruo Kobayashi, Ichihara (JP)

(73) Assignee: Idemitsu Petrochemical Co., Ltd., Tokyo (JP)

( * ) Notice: Subject to any disclaimer, the term of this patent is extended or adjusted under 35 U.S.C. 154(b) by 0 days.

(21) Appl. No.: 09/581,206

(22) PCT Filed: Oct. 19, 1999

(86) PCT No.: PCT/JP99/05759

§ 371 Date: Jun. 21, 2000

§ 102(e) Date: Jun. 21, 2000

(87) PCT Pub. No.: WO00/24090

PCT Pub. Date: Apr. 27, 2000

(30) Foreign Application Priority Data

Oct. 21, 1998 (JP) ..... 10-299404

(51) Int. Cl.[7] ..... H01R 13/64
(52) U.S. Cl. ..... 439/680
(58) Field of Search ..... 439/680, 355, 439/901, 218, 701

(56) References Cited

U.S. PATENT DOCUMENTS

| | | | | |
|---|---|---|---|---|
| 3,137,535 | * | 6/1964 | Collier et al. | 439/680 |
| 3,399,374 | * | 8/1968 | Pauza et al. | 439/680 |
| 4,764,129 | * | 8/1988 | Jones et al. | 439/680 |
| 5,314,356 | * | 5/1994 | Isohata et al. | 439/680 |

* cited by examiner

*Primary Examiner*—Tho D. Ta
(74) *Attorney, Agent, or Firm*—Oblon, Spivak, McClelland, Maier & Neustadt, P.C.

(57) ABSTRACT

A box-shaped connector comprising: upper and lower side walls; and an insulating wall jointing said two side walls such that said box-shaped connector is formed to have a section generally of letter "C" by said side walls and said insulating wall, wherein a recess is formed over the face of the insulating wall on a socket insertion side and in the vicinity of a corner made between the side wall and the insulating wall, and wherein the smallest thickness (Tn) of the insulating wall is smaller than the thickness (Tr) of the side walls at portions where the face of the insulating wall on the socket inserting side intersects the side walls. The connector is so shaped as to properly disperse a stress generated when a socket is inserted, thereby to prevent cracks or breakages effectively.

11 Claims, 5 Drawing Sheets

CONNECTOR FOR A SOCKET

TECHNICAL FIELD

The present invention relates to a box-shaped connector and, more particularly, to a box-shaped connector having a shape effective for preventing cracks or breakages.

BACKGROUND OF THE INVENTION

Not only in electronic devices such as TV sets or personal computers but also in automobiles or industrial devices, there have been used a number electronic parts, major ones of which can be exemplified by connectors and sockets. Most of these connectors used are generally box-shaped to have a length of several centimeters and a section of about 1 cm×1 cm. As shown in FIG. 1, the connector and the socket are conducted by inserting the socket into the connector so that they function as the electronic part. Usually, the connector and the socket thus function as the integral part and are therefore demanded to be accurately connected. As means for this desire, the connector is provided with an erroneous insertion preventing slot, whereas the socket is provided with a bump (or a raised portion) to be snugly fitted in that erroneous insertion preventing slot (as shown in FIG. 1).

Thus, the bump of the socket is fitted in the erroneous insertion preventing slot of the connector. When the socket is to be inserted, there has frequently arisen a problem that a stress concentrates in the vicinity of the erroneous insertion preventing slot of the connector so that the erroneous insertion preventing slot is cracked or broken (as shown in FIG. 2 and FIG. 3).

The present invention has been conceived from the aforementioned point of view and has an object to provide a connector which is so shaped as to properly disperse a stress generated when a socket is inserted, thereby to prevent cracks or breakages effectively.

DISCLOSURE OF THE INVENTION

We have made keen investigations and have found that the above-specified problem could be solved by making an insulating wall of such box-shaped connector into a specific shape. The present invention has been completed on the basis of such founding.

According to one aspect of the present invention,

A box-shaped connector includes upper and lower side walls and an insulating wall jointing the upper and lower side walls such that the box-shaped connector is formed to have a section generally of letter "C" by the side walls and the insulating wall, wherein a recess is formed over the face of the insulating wall on a socket insertion side and in the vicinity of a corner made between the side wall and the insulating wall, and wherein the smallest thickness (Tn) of the insulating wall is smaller than the thickness (Tr) of the side walls at portions where the face of the insulating wall on the socket inserting side intersects the side walls.

A box-shaped connector according to another aspect of the present invention, wherein a recess is formed over the face of the insulating wall on the side other than the socket inserting side and in the vicinity of a corner made between the side wall and the insulating wall.

A box-shaped connector according to yet another aspect of the present invention, wherein the recess of claim 1 has a groove depth of 0.5 to 1.0 mm.

A box-shaped connector according to yet another aspect of the present invention, wherein the groove of the recess of claim 1 or 2 has an inside corner formed of a curve having a curvature (R).

A box-shaped connector according to yet another aspect of the present invention, wherein the Tr and Tn has a relation of Tn (mm)=Tr (mm)−(0.05 to 0.15) mm.

A box-shaped connector according to yet another aspect of the present invention, wherein the material is styrene polymers mainly having a syndiotactic structure or resin composites containing the styrene polymers mainly having the syndiotactic structure.

DESIGNATION OF REFERENCE NUMERALS

Figure 1:
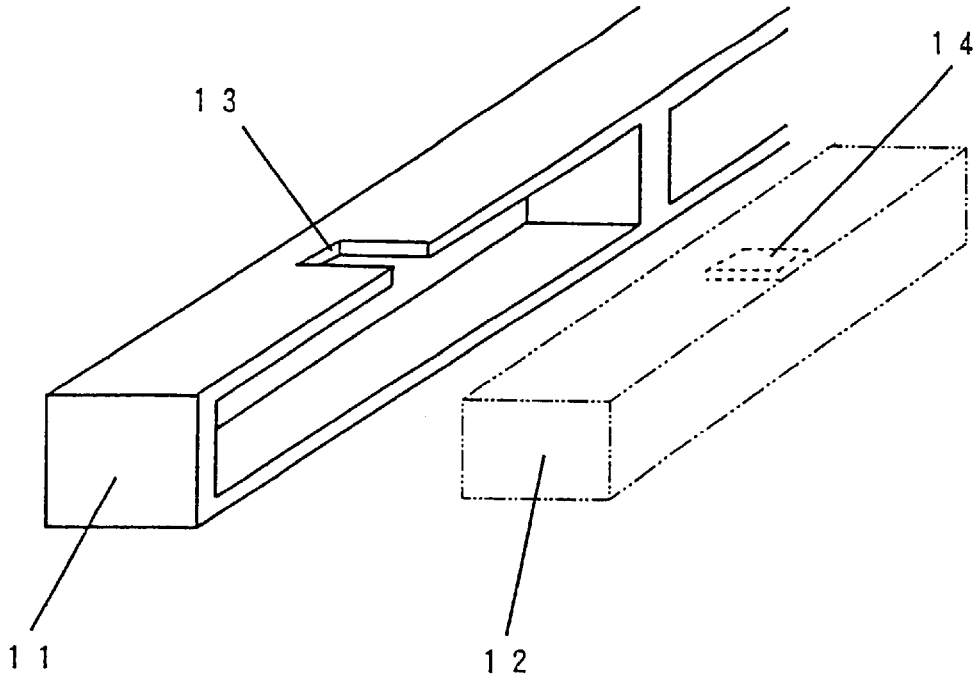
FIG. 1 BACKGROUND ART
FIG. 1 shows a schematic sketch of a connector and a socket.
Figure 2:
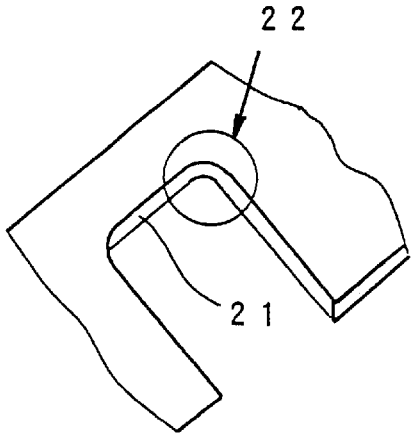
FIG. 2 BACKGROUND ART
FIG. 2 shows a schematic view of an erroneous insertion preventing slot in the connector.

The reference numerals in the individual Figures are as follows:

11: Connector
12: Socket
13: Erroneous Insertion Preventing Slot
14: Bump (Raised Portion)
21: Erroneous Insertion Preventing Slot
22: Stress Concentrating Portion
31: Side Wall
32: Insulating Wall
33: Stress Concentrating Portion
34: Socket
41: Side Wall
42: Insulating Wall
43: Socket Inserting Side
44: Recess
51: Side Wall
52: Insulating Wall
53: Socket Inserting Side
54: Corner between Side Wall and Socket Inserting Side
55: Corner of Recess on Socket Inserting Side
56: Side Wall Thickness (Tr) at Portion where Socket Inserting Side Intersects Side Wall

57: Thickness (Tn) of Thinnest Portion of Insulating Wall

58: Groove Depth (Dp) in Recess

59: Corner (R) Having Internal Curvature of Groove of Recess

510: Recess Width (Ln)

71: Side Wall

72: Insulating Wall

73: Socket Inserting Side

74: Recess

75: Side Wall

76: Insulating Wall

81: Depression Applied Portion

82: Erroneous Insertion Preventing Slot

BEST MODE FOR CARRYING OUT THE INVENTION

The present invention will be described in detail in the following.

1. Shape of Box-Shaped Connector

Figure 4:
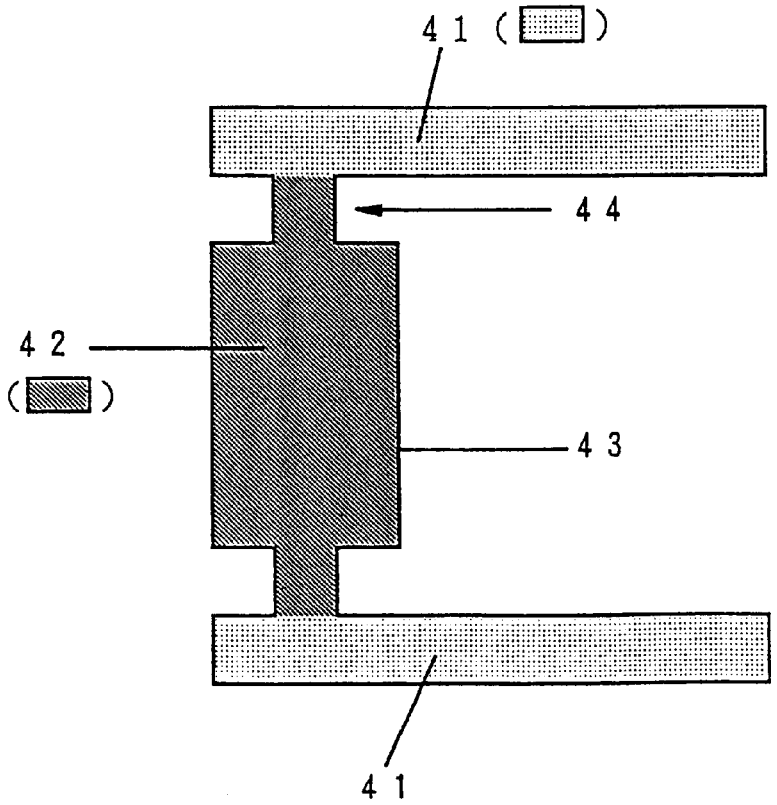
FIG. 4 shows a cross-sectional view of a preferred embodiment of a box-shaped connector according to the present invention.
Figure 5A:
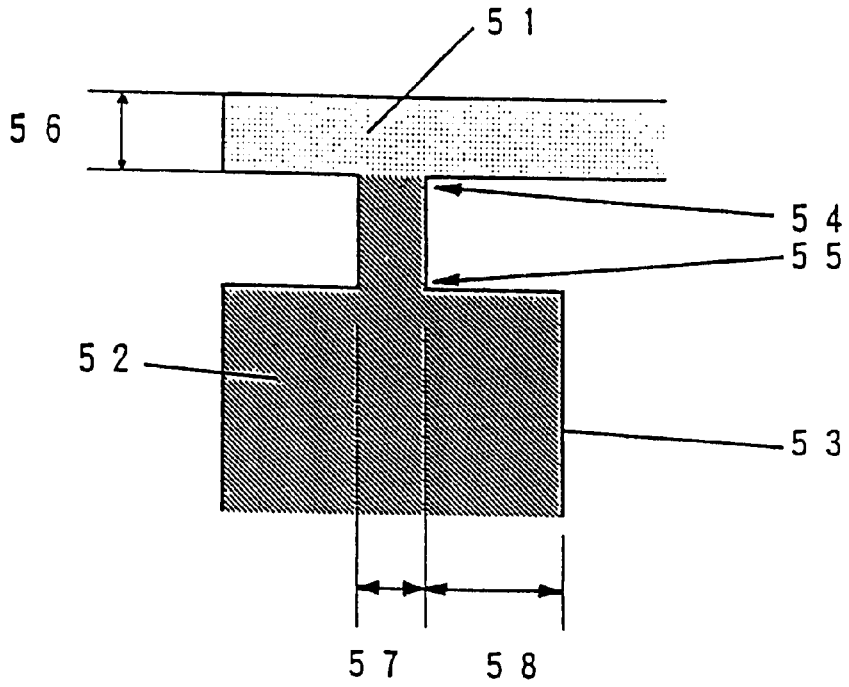
FIGS. 5(A) and 5(B) show enlarged cross-sectional views of a recess.
Figure 5B:
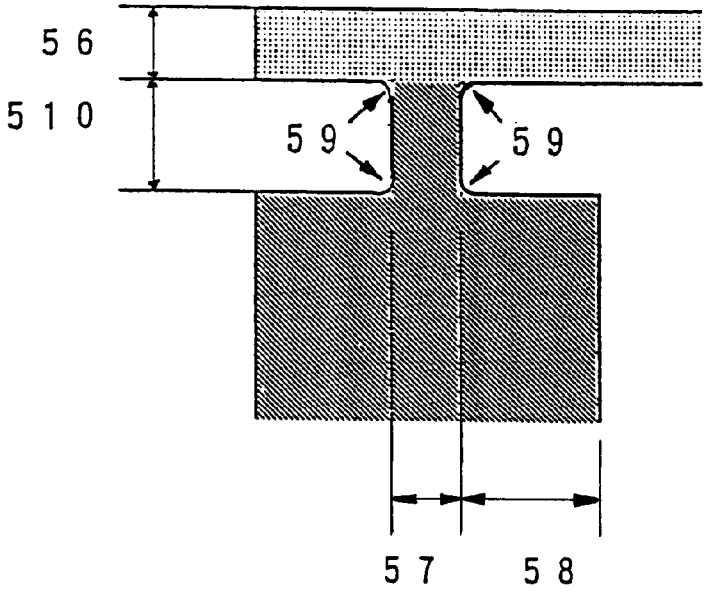
Figure 6A:
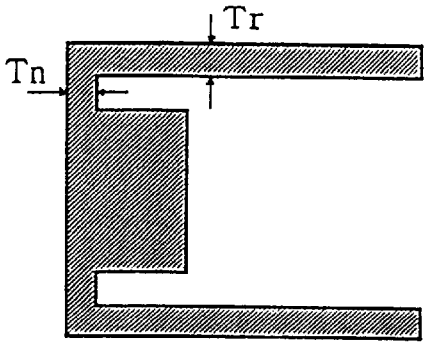
FIGS. 6(A), 6(B), 6(C) and 6(D) show cross-sectional views of various modes of the box-shaped connector according to the present invention.
Figure 6B:
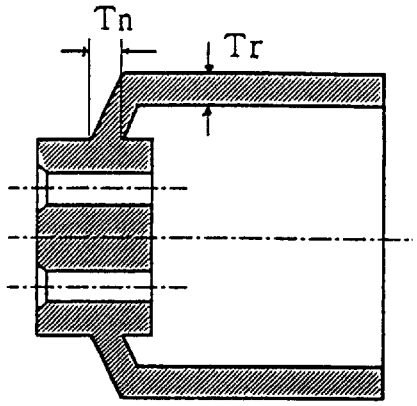
Figure 6C:
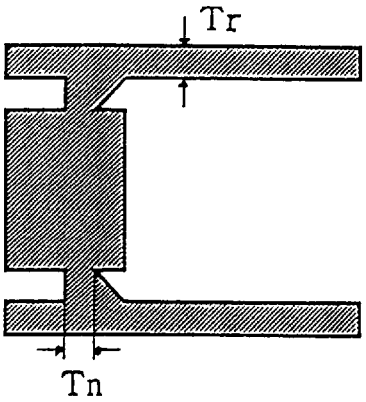
Figure 6D:
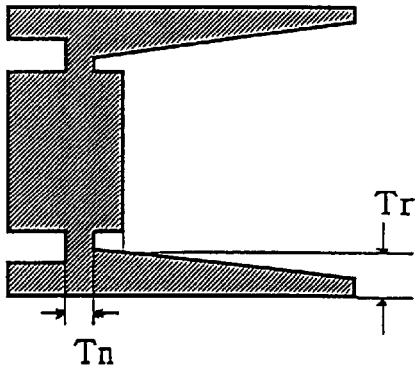

According to the present invention, as exemplified in FIG. 4 and FIG. 5, there is provided a box-shaped connector comprising: upper and lower side walls; and an insulating wall jointing the two side walls such that the box-shaped connector is formed to have a section generally of letter "C" by the side walls and the insulating wall, wherein a recess is formed over the face of the insulating wall on a socket insertion side and in the vicinity of a corner made between the side wall and the insulating wall, and wherein the smallest thickness (Tn) of the insulating wall is smaller than the thickness (Tr) of the side walls at portions where the face of the insulating wall on the socket inserting side intersects the side walls.

Figure 3:
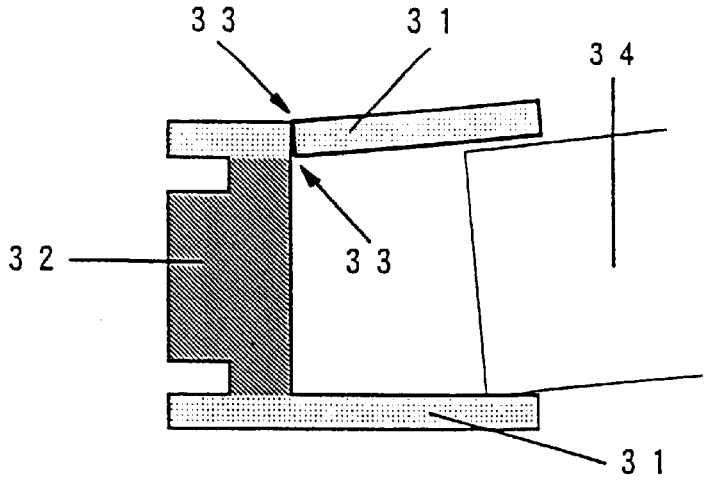
FIG. 3 BACKGROUND ART
FIG. 3 shows a cross-sectional view of a connector of the prior art.

In this box-shaped connector of the prior art type, a stress is applied to warp the side walls when a socket is inserted. In this case, as exemplified in FIG. 3, the stress concentrates on the side wall in the vicinity (as indicated at "33" in FIG. 3) of the corner which is made between the side wall and the insulating wall. As a result, the side walls are liable to be folded or cracked at such portions. On the contrary, the box-shaped connector according to the present invention is given a structure for damping the concentration of stress, as might otherwise occur on the side wall and in the vicinity of the corner made between the side wall and the insulating wall.

① Preferred Mode

A preferred shape of the box-shaped connector according to the present invention can be specifically embodied to have a structure shown in FIG. 4. A detailed description will be made with reference to FIG. 4 and FIG. 5 showing an enlarged view of the recess.

FIG. 4 is a schematic sectional view of the preferred shape of the box-shaped connector according to the present invention. This box-shaped connector is constructed to include two side walls ("41" in FIG. 4) and an insulating wall ("42" in FIG. 4) bridging the two side walls so that it is formed into a section generally of letter "C" by those faces. The box-shaped connector takes a structure in which a recess ("44" in FIG. 4) is formed over the face ("43" in FIG. 4) of the insulating wall on the socket inserting side and in the vicinity of a corner ("54" in FIG. 5) made between the side wall and the insulating wall. In this case, the stress by a warpage to be applied to the side wall when the socket is inserted is not concentrated on the side wall only in the vicinity ("54" in FIG. 5) of the corner made between the side wall and the insulating wall but dispersed to the corner ("55" in FIG. 5) of the recess over the socket inserting side. As a result, the allowable deformation to be obtained by the side wall ("51" in FIG. 5) is so far larger than that of the prior art (i.e., the case of FIG. 3) as to reduce the possibility of breakage extremely. Here, the recess may be formed not only on the socket inserting side but also on the other side, as shown in FIG. 4.

In the present invention, it is essential that the smallest thickness (Tn at "57" in FIG. 5) of the insulating wall be smaller than the thickness (Tr at "56" in FIG. 5) of the side wall at a portion where the face of the insulating wall on the socket inserting side intersects the side wall. If Tn is larger than Tr, the stress to be applied to the vicinity ("54" in FIG. 5) of the corner made between the side wall and the insulating wall is higher than that to be applied to the corner ("55" in FIG. 5) of the recess over the face on the socket inserting side. As a result, the allowable deformation to be obtained by the side wall is so small that the side wall is liable to break. Specifically, the thickness Tn (in mm) is desired to be smaller than the thickness Tr (in mm) by 0.05 to 0.15 mm.

Moreover, the recess is preferred to have a groove depth (Dp at "58" in FIG. 5) of 0.5 to 1.0 mm or more preferably 0.5 to 0.7 mm. If less than 0.5 mm, the rigidity at the corner ("55" in FIG. 5) of the recess over the face of the socket inserting side becomes so large that the allowable deformation to be obtained by the side wall may not become large thereby to fail to exhibit the effect of forming the recess sufficiently. If more than 1.0 mm, on the other hand, the bending moment of the deformation of the side wall grows so high that the side wall may be easily folded at its root. In the recess, on the other hand, the inside corner of its groove may be formed of a curve having a curvature (R). With this curve, it is possible to reduce the concentration of stress more. On the other hand, the recess is preferred to have a width (Ln at "510" in FIG. 5) of 0.6 to 1.0 mm or more preferably 0.75 to 0.85 mm.

② Other Shapes

The shape of the box-shaped connector according to the present invention should not be limited to the foregoing one ① but can be enumerated by the following shapes shown at (A) to (D) in FIG. 6. At (A) in FIG. 6, more specifically, the aforementioned recess is not formed in the face of the insulating wall other than on the socket inserting side. On the other hand, the shape of the recess need not be rectangular but may be modified generally into a letter "V", as exemplified at (B) to (D) in FIG. 6.

Figure 7:
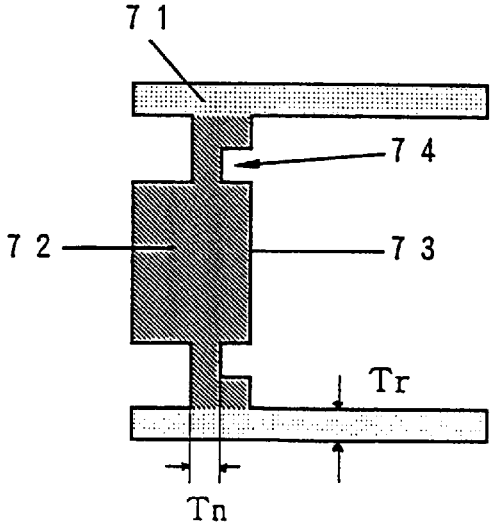
FIG. 7 shows a cross-sectional view of one embodiment of the box-shaped connector according to the present invention.

As shown in FIG. 7, moreover, the groove of the recess ("74" in FIG. 7) need not be positioned to contact with the side wall but may be present completely over the face of the socket inserting side. Here, the thicknesses Tn and Tr at (A) to (D) in FIG. 6 and in FIG. 7 are as they are shown in FIG. 6 and FIG. 7.

2. Materials of Box-Shaped Connector

The materials to be used for the box-shaped connector according to the present invention should not be especially limited but are preferably exemplified by either styrene polymers mainly having a syndiotactic structure or resin composites containing the styrene polymers mainly having the syndiotactic structure.

(1) Styrene Polymers Mainly Having Syndiotactic Structure (as may be called "syndiotactic polystyrene" or simply "SPS")

The syndiotactic structure in the styrene polymers mainly having the syndiotactic structure is a stereoscopic structure in which the stereochemical structure has the syndiotactic structure, that is, in which side chains or phenyl groups are alternately positioned in opposite directions with respect to a principal chain composed of a carbon-carbon bond, and its tacticity is determined by the nuclear magnetic resonance method ($^{13}$C-NMR) using isotopic carbons. The tacticity to be measured by the $^{13}$C-NMR method can be indicated in terms of the ratio of presence of a plurality of continuous component units, e.g., dyads for two components, triads for three and pentads for five. The styrene polymer, as termed in the present invention to mainly have the syndiotactic structure, is indicated to include: polystyrene, poly-(alkylstyrene), poly-(halogenated styrene), poly-(halogenated alkylstyrene), poly-(alkoxystyrene) or poly-(vinyl benzoate) having a syndiotacticity containing usually 75% or more or preferably 85% or more racemic diads or 30% or more or preferably 50% or more racemic pentads; their hydrogenated polymers or mixtures thereof; or copolymers containing them as main components. Here, the poly-(alkylstyrene) is exemplified by poly-(methylstyrene), poly-(ethylstyrene), poly-(polystyrene), poly-(tertiary butyl styrene), poly-(phenyl styrene), poly-(vinyl naphthalene) or poly-(vinyl styrene), and the poly-(halogenated styrene) is exemplified by poly-(chlorostyrene), poly-(bromostyrene) or poly-(fluorostyrene). On the other hand, the poly-(halogenated alkylstyrene) is exemplified by poly-(chloromethystyrene), and the poly-(alkoxystyrene) is exemplified by poly-(methyxystyrene) or poly-(ethoxystyrene).

Of these, the preferable styrene polymer can be exemplified by polystyrene, poly-(p-methylstyrene), poly-(m-methylstyrene), poly-(p-tertiary butylstyrene), poly-(p-chlorostyrene), poly-(m-chlorostyrene), poly-(p-fluorostyrene) or hydrogenated polystyrene, or a copolymer containing those structural units.

These styrene polymers mainly having the syndiotactic structure can be produced (as disclosed in Unexamined Published Japanese Patent Application No. 62-187708) by polymerizing a styrene monomer (monomer for the above-specified styrene polymer), for example, either in a solvent of inactive hydrocarbons or in the absence of a solvent and with a catalyst of a condensation product of titanium compound, water and trialkyl aluminum. On the other hand, the poly-(halogenated alkylstyrene) can be produced by the method of Unexamined Published Japanese Patent Application No. 1-46912, and their hydrogenated polymers can be produced by the method of Unexamined Published Japanese Patent Application No. 1-178505.

(2) Resin Compound Containing SPS

The molding material can be exemplified by not only the SPS but also a resin composite containing the SPS. This resin component may contain the SPS as ① the resin component, and another resin component can be exemplified by a thermoplastic resin other than a rubbery elastomer and/or SPS. In addition, there can be blended ② an inorganic filler and ③ a variety of additives such as an anti-oxidizing agent, a nucleating agent, an antistatic agent, process oil, a plasticizing agent, a parting agent, a fire retardant, a fire retardation aiding agent or a pigment.

On the other hand, the kneading of the above-specified individual components may be effected by various methods including a method ① of blending and melting/kneading the components at any of the steps of the SPS producing process, and a method ② of blending and melting/kneading the individual components of the composite.

① Resin Component

For the blending ratio in the resin component, the SPS is at 10 to 98 wt. %, preferably 20 to 98 wt. % or more preferably 40 to 98 wt. %, and the total of the rubbery elastomer and a thermoplastic resin other than the SPS is at 2 to 90 wt. %, preferably 2 to 80 wt. % or more preferably 2 to 60 wt. %.

(a) Rubbery Elastomer

The rubbery elastomer can be specified by natural rubber; polybutadiene; polyisoprene; polyisobutylene; neoprene; polysulfide rubber; Thiokol rubber; acrylic rubber; urethane rubber; silicone rubber; epichlorohydrin rubber; styrene-butadiene block copolymer (SBR); hydrogenated styrene-butadiene block copolymer (SEB); styrene-butadiene-styrene block copolymer (SBS); hydrogenated styrene-butadiene-styrene block copolymer (SEBS); styrene-isoprene block coplymer (SIR); hydrogenated styrene-isoprene block copolymer (SEP); styrene-isoprene-styrene block copolymer (SIS); hydrogenated styrene-isoprene-styrene block copolymer (SEPS); olefin rubber such as ethylene propylene rubber (EPM), ethylene-propylene-diene rubber (EPDM) or a straight-chain low-density polyethylene elastomer; a core shell type granular elastomer such as butadiene-acrylonitrile-styrene-core shell rubber (ABS), methyl methacrylate-butadiene-styrene-core shell rubber (MBS), methyl methacrylate-butylacrylate-styrene-core shell rubber (MAS), octylacrylate-butadiene-styrene-core shell rubber (MABS), alkylacrylate-butadiene-acrylonitrile-styrene-core shell rubber (AABS), butadiene-styrene-core shell rubber (SBR) or siloxane containing core shell rubber including metylmethacrylate-butylacrylate-siloxane; or rubber modified from them.

(b) Thermoplastic Resin Other Than SPS The thermoplastic resin other than the SPS to be used can be arbitrarily selected from any of the well-known resins: a polyolefin resin represented by straight-chain high-density polyethylene, straight-chain low-density polyethylene, high-pressure-processed low-density polyethylene, isotactic polypropylene, syndiotactic polypropylene, block polypropylene, random polypropylene, polybutene, 1,2-polybutadiene, 4-methylpentene and cyclopolyolefin, and their copolymers; a polystyrene resin represented by isotactic polystyrene, isotactic polystyrene, HIPS, ABS, AS, styrene-methacrylate copolymer, styrene-methacrylate/alkylester copolymer, styrene-methacrylate/glycidyl ester copolymer, styrene-acrylate copolymer, styrene-acrylate/alkyl ester copolymer, styrene-maleate copolymer and styrene fumarate copolymer; a polyester resin such as polycarbonate, polyethylene terephthalate or polybutylene terephthalate; a polyamide resin such as polyamide 6 or polyamide 6, 6; polyphenylene ether; and PPS. Here, it is possible to use only one kind of thermoplastic resin solely or two or more kinds in combination.

③ Other Components (a) Various Additives

A variety of additives to be exemplified in the following can be blended so long as they are not detrimental to the object of the present invention.

(i) Antioxidant

The antioxidant to be used can be arbitrarily selected from the well-known phosphor, phenol and sulfur families. Here, it is possible to use only one kind of antioxidant solely or two more kinds in combination.

(ii) Nucleator

The nucleator to be used can be arbitrarily selected from the well-known nucleators: a metal carboxylate such as aluminum di-(p-t-butyl benzoate); a metal phosphate such as methylene-bis-(2, 4-di-t-butyl phenol) acid phosphate sodium; talc and phthalocyanine derivative. Here, it is possible to use only one kind of nucleator solely or two more kinds in combination.

(iii) Plasticizer

The plasticizer to be used can be arbitrarily selected from the well-known plasticizers including polyethylene glycol, polyamide oligomer, ethylene-bis-stearoamide, phthalic ester, polystyrene oligomer, polyethylene was or silicone oil. Here, it is possible to use only one kind of plasticizer solely or two more kinds in combination.

(iv) Parting Agent

The parting agent to be used can be arbitrarily selected from the well-known parting agents including polyethylene wax, silicone oil, a long-chain carboxylic acid and long-chain metal carboxylate. Here, it is possible to use only one kind of parting agent solely or two more kinds in combination.

(v) Process Oil

In the present invention, process oil having a kinematic viscosity of 15 to 600 centistokes (cs) at 40° C. is preferably blended for improving the elongation.

The process oil is coarsely divided according to the oil kinds into paraffin family oil, naphthene family oil and aromatic family oil, of which paraffin family oil having 60% Cp or more of the number of carbons relating to paraffin (or straight chains), as calculated by the n-d-M method, is preferred.

The viscosity of the process oil is preferably at a kinematic viscosity of 15 to 600 cs at 40° C. or more preferably at 15 to 500 cs.

Although the elongation improving effect is obtained for the kinematic viscosity of the process oil less than 15 cs, the boiling point is so low as will cause white smoke, gas burning or rolling adhesion when the process oil is melted/kneaded with SPS and molded. If the kinematic viscosity exceeds 600 cs, on the other hand, the white smoke or gas burning is suppressed, but the elongation improving effect is insufficient.

The amount of the process oil to be added is preferable at 0.01 to 1.5 wt. parts, more preferable at 0.05 to 1.4 wt. parts or still more preferable at 0.1 to 1.3 wt. parts with respect to the total of 100 wt. parts of the resin components in the aforementioned resin composite.

Here, it is possible to use only one kind of process oil solely or two more kinds in combination.

3. Method of Manufacturing Box-Shaped Connector according to Present Invention

No special restriction is imposed on the method of manufacturing the box-shaped connector according to the present invention, but its molding method can be exemplified by the well-known method such as the injection molding method.

EMBODIMENTS

The present invention will be described in detail in connection with its embodiments and comparisons but should not be limited to those embodiments.

Example 1

60 wt. % of SPS (syndiotactic polystyrene homopolymer Tm=270° C., MI=13 (at 300° C., 1.2 Kgf)), 8 wt. % of SEBS (hydrogenated styrene-butadiene copolymer known under the trade name of "Septon 8006" by Kurare) as the rubbery elastomer, 30 wt. % of glass fiber (known under the trade name of "FT164" by Asahi Glass Fiber), and 2 wt. % of modified polyphenylene ether fumarate (at a modification factor of 1.5 wt. %) were dry-blended and were melted/kneaded by a biaxial extruder of 65 mm ϕ to prepare pellets.

Here, the modified polyphenylene ether fumarate was prepared by the following method. 1 Kg of polyphenylene ether (having an intrinsic viscosity of 0.45 dl/g in chloroform at 25° C.), 30 g of fumaric acid, and 20 g of 2,3-dimethyl-2,3-diphenyl butane (i.e., Nofmer BC by Nippon Yushi) as a radical generator were dry-blended and were melted/kneaded by a biaxial extruder of 30 mm at a screw speed of 200 rpm at a set temperature of 300° C. The strands were cooled and then pelletized to prepare the modified polyphenylene ether fumarate. For measuring the modification factor, 1 g of the modified polyphenylene ether prepared was dissolved in ethyl benzene and was reprecipitated in methanol. The recovered polymer was extracted with methanol by the Sxhlet extractor and was dried. After this, the modification factor was determined with the intensity and titration of carbonyl absorption of IR spectrum.

Figure 8:
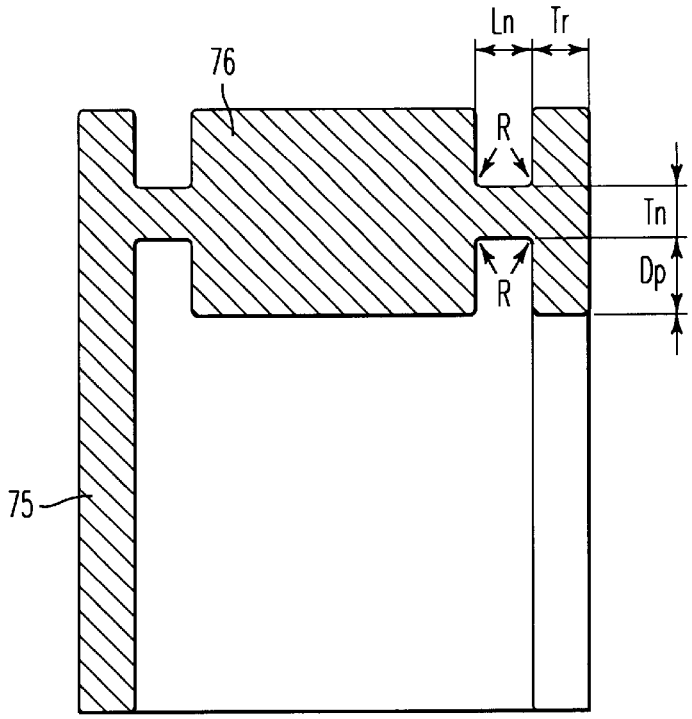
FIG. 8 shows a cross-sectional view and sizes (in mm) of the box-shaped connector which was used in the embodiment and the comparison.
Figure 9A:
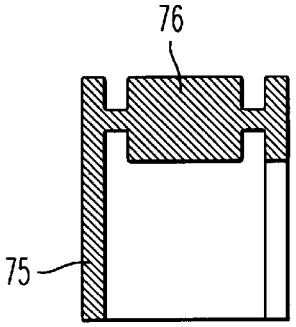
FIGS. 9(A), 9(B), 9(C) and 9(D) show a cross-sectional view of the box-shaped connector which was used in embodiments, example 1(A) and example 2(B) and comparisons, comparison 1(C) and comparison 2(D).
Figure 9B:
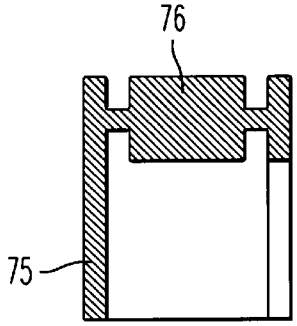
Figure 9C:
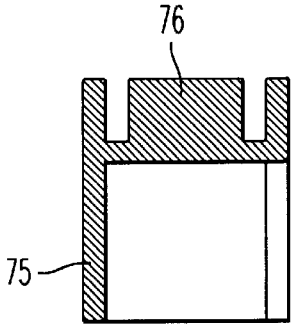
Figure 9D:
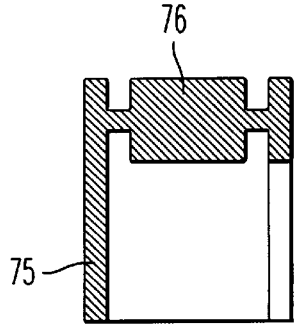

These pellets were injection-molded under the conditions of a cylinder temperature of 290° C. and a mold temperature of 145° C. to manufacture a box-shaped connector having a section shaped as shown in FIG. 9. This box-shaped connector has sizes at its individual portions, as enumerated in Table 1 and shown in FIG. 8.

For these ten samples, a depression (of 29.4N) was applied, to the side wall in the vicinity of the erroneous insertion preventing slot. The results are enumerated in Table 1.

Example 2

This Example 2 was similar to Example 1 excepting that the sizes of the individual portions were changed, as enumerated in Table 1. The results are enumerated in Table 1.

Comparison 1

Materials similar to those of Example 1 were used to manufacture a box-shaped connector having a shape shown in FIG. 9. This box-shaped connector has sizes at its individual portions, as enumerated in Table 1 and shown in FIG. 8.

For these ten samples, a depression was applied, to the side wall in the vicinity of the erroneous insertion preventing slot. The results are enumerated in Table 1.

Comparison 2

This Example 2 was similar to Example 1 excepting that the sizes of the individual portions were changed, as enumerated in Table 1. The results are enumerated in Table 1.

TABLE 1

| | | | | | | Of 10 Samples | |
|---|---|---|---|---|---|---|---|
| | Dp (mm) | Tn (mm) | Tr (mm) | R (mm) | Ln (mm) | No. of Breaks | No. of Cracks |
| Ex. 1 | 0.60 | 0.80 | 0.95 | 0 | 0.83 | 0 | 2 |
| Ex. 2 | 0.60 | 0.80 | 0.95 | 0.10 | 0.83 | 0 | 0 |
| Comp. 1 | 0 | 0.80 | 0.95 | 0 | 0.83 | 10 | 0 |
| Comp. 2 | 0.60 | 1.15 | 0.87 | 0 | 0.76 | 8 | 2 |

INDUSTRIAL APPLICABILITY

According to the present invention, it is possible to provide a connector which is so shaped as to properly disperse a stress generated when a socket is inserted, thereby to prevent cracks or breakages effectively.

What is claimed is:

1. A connector comprising:

an upper side wall and a lower side wall; and an insulating wall joining said upper and lower side walls to form a socket insertion side, said insulating wall having a recess formed on said socket insertion side of the insulating wall, said recess being positioned in vicinity of a corner made between one of said upper and lower side walls and the insulating wall, wherein;

said recess in the insulating wall has a smallest thickness portion whose thickness is thinner than a thickness of each of the upper and lower side walls;

the connector comprises at least one of a styrene polymer mainly having a syndiotactic structure and a resin composite containing a styrene polymer mainly having a syndiotactic structure.

2. A connector as set forth in claim 1, wherein said recess is formed over a face of the insulating wall on a side other than the socket inserting side.

3. A connector as set forth in claim 1, wherein the recess comprises a groove having a depth of 0.5 to 1.0 mm.

4. A connector as set forth in claim 1, wherein the recess comprises a groove having an inside corner having a curvature.

5. A connector as set forth in claim 1, wherein the smallest thickness portion and the upper and lower side walls have a relationship, Tn (mm)=Tr (mm)−0.05 to 0.15 (mm), wherein the Tn is a thickness of said smallest thickness portion and the Tr is the thickness of the upper and lower side walls.

6. A connector comprising:

an upper side wall;

a lower side wall provided parallel to the upper side wall; and an insulating wall jointing said upper and lower side walls and forming a socket insertion side with said upper and lower side walls, said insulating wall having at least one recessed portion substantially adjacent to said upper and lower side walls, respectively, said at least one recessed portion being recessed on said socket insertion side of said insulation wall, wherein said at least one recessed portion has a thickness thinner than a thickness of each of said upper and lower side walls.

7. A connector as set forth in claim 6, wherein said at least one recessed portion is recessed on said socket insertion side and an opposite side of said socket inserting side.

8. A connector as set forth in claim 6, wherein said at least one recessed portion comprises at least one groove having a depth of 0.5 to 1.0 mm.

9. A connector as set forth in claim 6, wherein:

said at least one recessed portion comprises at least one groove; and said at least one groove has rounded inside corners.

10. A connector as set forth in claim 6, wherein said at least one recessed portion and said upper and lower side walls have a relationship, Tn (mm)=Tr (mm)−0.05 to 0.15 (mm), wherein said Tn is a thickness of said at least one joining portion and said Tr is a thickness of said upper and lower side walls.

11. A connector as set forth in claim 6, wherein said connector comprises at least one of a styrene polymer mainly having a syndiotactic structure and a resin composite containing a styrene polymer mainly having a syndiotactic structure.

* * * * *